US009375834B2

(12) United States Patent
Geraghty

(10) Patent No.: US 9,375,834 B2
(45) Date of Patent: Jun. 28, 2016

(54) SAWHORSE

(75) Inventor: Cyril Martin Geraghty, Clondra (IE)

(73) Assignee: Glebe Fabrications Limited, County Longford (IE)

( * ) Notice: Subject to any disclaimer, the term of this patent is extended or adjusted under 35 U.S.C. 154(b) by 98 days.

(21) Appl. No.: 14/009,639

(22) PCT Filed: Apr. 5, 2012

(86) PCT No.: PCT/IE2012/000016

§ 371 (c)(1),
(2), (4) Date: Oct. 3, 2013

(87) PCT Pub. No.: WO2012/137193

PCT Pub. Date: Oct. 11, 2012

(65) Prior Publication Data

US 2014/0021670 A1 Jan. 23, 2014

(30) Foreign Application Priority Data

Apr. 6, 2011 (IE) ..... S2011/0167

(51) Int. Cl.

| | |
|---|---|
| ***B25H 1/06*** | (2006.01) |
| ***B25H 1/10*** | (2006.01) |
| ***B27B 21/00*** | (2006.01) |
| ***B27B 17/00*** | (2006.01) |
| ***B25B 1/06*** | (2006.01) |

(52) U.S. Cl.

CPC .. *B25H 1/06* (2013.01); *B25B 1/06* (2013.01); *B25H 1/10* (2013.01); *B27B 17/0075* (2013.01); *B27B 21/00* (2013.01)

(58) Field of Classification Search

CPC ..... B25H 1/06; B27B 1/0075; B27B 1/0058; B27B 21/00

USPC ..... 269/237

See application file for complete search history.

(56) References Cited

U.S. PATENT DOCUMENTS

| | | | | |
|---|---|---|---|---|
| 4,468,018 | A * | 8/1984 | Vaizey | 269/54.5 |
| 4,641,822 | A * | 2/1987 | Fenerty | 269/296 |
| 4,718,652 | A * | 1/1988 | Liebenstein | 269/296 |
| 5,472,180 | A * | 12/1995 | Bent | 269/99 |
| 5,678,811 | A * | 10/1997 | Johnson | 269/237 |
| 6,322,064 | B1 * | 11/2001 | Tallving | 269/296 |
| 7,131,676 | B2 * | 11/2006 | Hoff | 294/17 |
| 7,464,973 | B1 | 12/2008 | Chapman et al. | |
| 2010/0156018 | A1 * | 6/2010 | Maire | 269/296 |

FOREIGN PATENT DOCUMENTS

| | | |
|---|---|---|
| AU | 600682 B2 | 8/1990 |
| GB | 2240229 A | 7/1991 |

OTHER PUBLICATIONS

International Search Report dated Jul. 4, 2012, for corresponding application PCT/IE2012/000016 and all references cited herein.

* cited by examiner

*Primary Examiner* — Joseph J Hail
*Assistant Examiner* — Henry Hong
(74) *Attorney, Agent, or Firm* — Olive Law Group, PLLC

(57) ABSTRACT

A self-adjusting and self-locking sawhorse made up of a frame for holding an item in a cantilevered position and self-adjusting jaw means on the frame for receiving the item, the self-adjusting jaw means being automatically responsive to the size of the item to hold the log in the sawhorse.

9 Claims, 9 Drawing Sheets

C

SAWHORSE

CROSS REFERENCE TO RELATED APPLICATIONS

This application is a 35 USC 371 application of International PCT Patent Application No. PCT/IE2012/000016 filed on Apr. 5, 2012, which claims priority to Ireland (IE) Patent Application 52011/0167 filed Apr. 6, 2011, the entire contents of both are hereby incorporated by reference herein in their entireties.

INTRODUCTION

This invention relates to a sawhorse and in particular to a self-adjusting and self-locking sawhorse.

BACKGROUND OF THE INVENTION

Sawhorses are devices widely used for holding and cutting timber. In the United States, sawhorses for cutting rough timber such as logs are referred to as sawbucks while the term sawhorse refers to a device for holding and cutting planks and the like. The term log holder can also be used for such devices. However, for the purposes of the present patent application, the term sawhorse is intended to refer to sawhorses, sawbucks and log holders for use in holding and cutting all timber types including logs, planks etc. Moreover, reference to timber, logs and the like should also be construed to include reference to planks etc.

In its most basic form, a sawhorse can be made up of two or more joined X-frames defining a cradle in which a log can be placed for cutting. Such basic devices generally require the manual re-positioning of the log in the sawhorse after each cut and also fail to grip the log. Accordingly, use of such basic sawhorses can be cumbersome and awkward. Sawhorses are also known which can grip the log or plank to be cut by manually adjusting the size of an aperture in the sawhorse for receiving the log or plank in accordance with the size of the log or plank. However, adjustment of the aperture size between logs can also be time consuming while considerable manual strength can be required to adjust the aperture to effectively hold the log securely in position.

SUMMARY OF THE INVENTION

According to the invention, there is provided a sawhorse comprising;

a frame;

a self-adjusting jaw means on the frame for receiving an item, the self-adjusting jaw means being automatically responsive to the size of the item to hold the item in the sawhorse.

Preferably, the jaw means comprises an upper jaw and a lower jaw spaced beneath the upper jaw. More preferably, the upper jaw comprises at least one pivotable jaw plate displaceable between a first position for receiving an item in the sawhorse and a second position for holding the item in the sawhorse.

Most preferably, the pivotable jaw plate is a pendent jaw plate.

Suitably, the pendent jaw plate is suspended from an upper jaw support bar on the frame.

Advantageously, the upper jaw comprises a plurality of jaw plates.

Preferably, the plurality of jaw plates is arranged in series in a substantially vertical plane, the series of jaw plates being pivotable between the first and second positions.

In one embodiment of the invention, the series of jaw plates is substantially V-shaped.

In an alternative embodiment of the invention, the series of jaw plates is substantially A-shaped.

Preferably, the self-adjusting jaw means are self-locking to prevent retraction of an item from the jaw means.

Suitably, the lower jaw comprises a jaw plate fixed to the frame.

Preferably, the jaw plates are serrated. More preferably, the serrated jaw plates comprise teeth for gripping an item.

Suitably, the frame is adapted to hold the item in the sawhorse in a cantilevered position. Preferably, the frame is substantially L-shaped in profile.

In a further embodiment, the invention also extends to a worktable or workbench comprising a sawhorse as hereinbefore defined.

The invention also extends to a sawhorse comprising a frame and a self-adjusting jaw means on the frame for receiving a log or the like, the self-adjusting jaw means being automatically responsive to the size of the log to hold the log in the sawhorse.

The sawhorse of the invention is self-adjusting and self-locking so that logs, planks and the like can be easily inserted and locked into a cantilevered position automatically in the sawhorse without requiring complex adjustments to the sawhorse. The cantilevered log can be cut continuously in-situ without requiring re-positioning of the log on the sawhorse. The sawhorse and in particular the jaw means can be sized to accommodate various ranges of log size as required while the self-adjusting and locking nature of the sawhorse renders the sawhorse suitable for cutting small and large diameter timber. The cantilevered nature of the sawhorse of the invention also renders the sawhorse highly stable so that a plank locked into position in the jaw means can even render the sawhorse suitable for use as a seat, worktable, workbench or similar.

BRIEF DESCRIPTION OF THE DRAWINGS

The invention will now be described, by way of example only, with reference to the accompanying drawings in which.

DETAILED DESCRIPTION OF THE INVENTION

Figure 1:
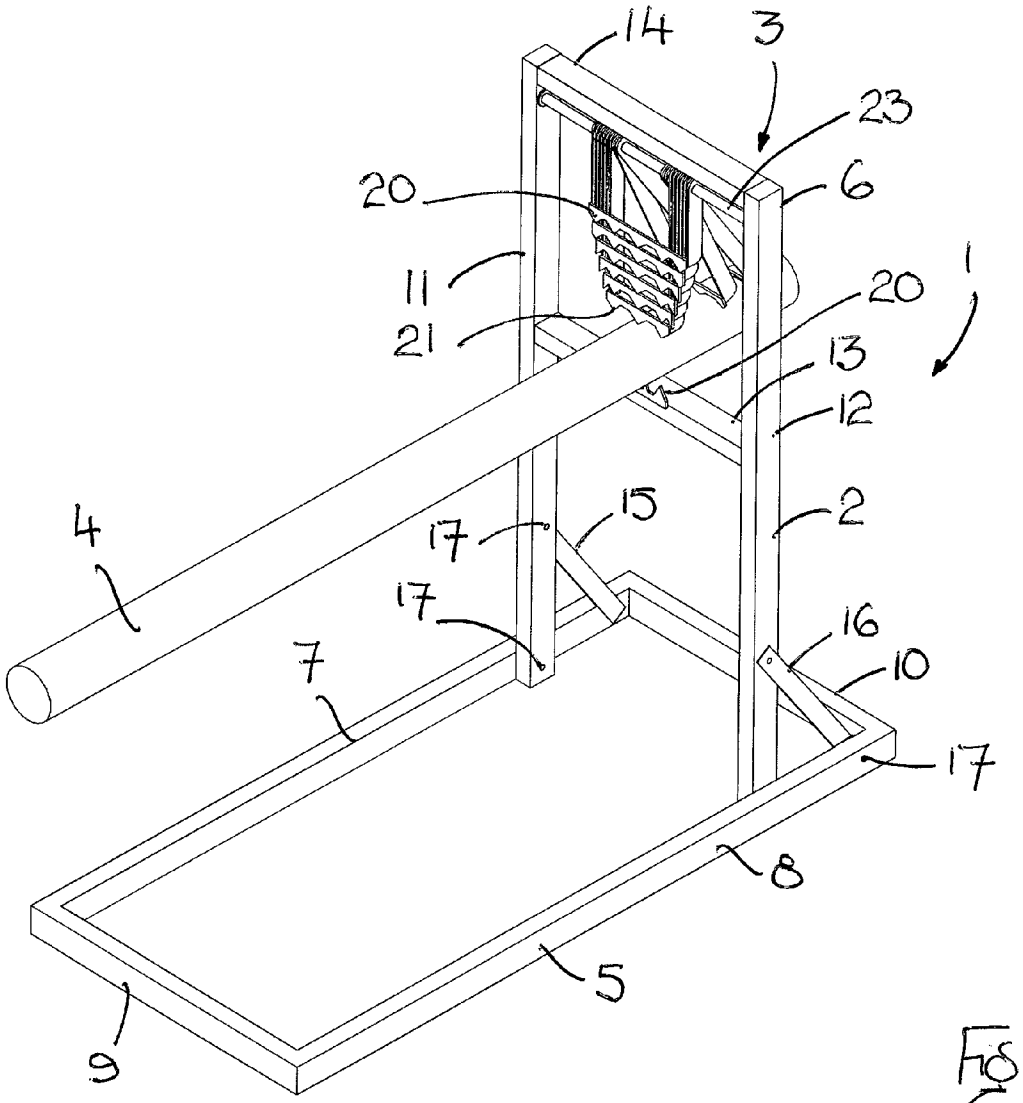
FIG. 1 is a front perspective view from above and one side of a first embodiment of sawhorse in accordance with the invention with a log held and locked in position in the self-adjusting and self-locking jaw means of the sawhorse.
Figure 2:
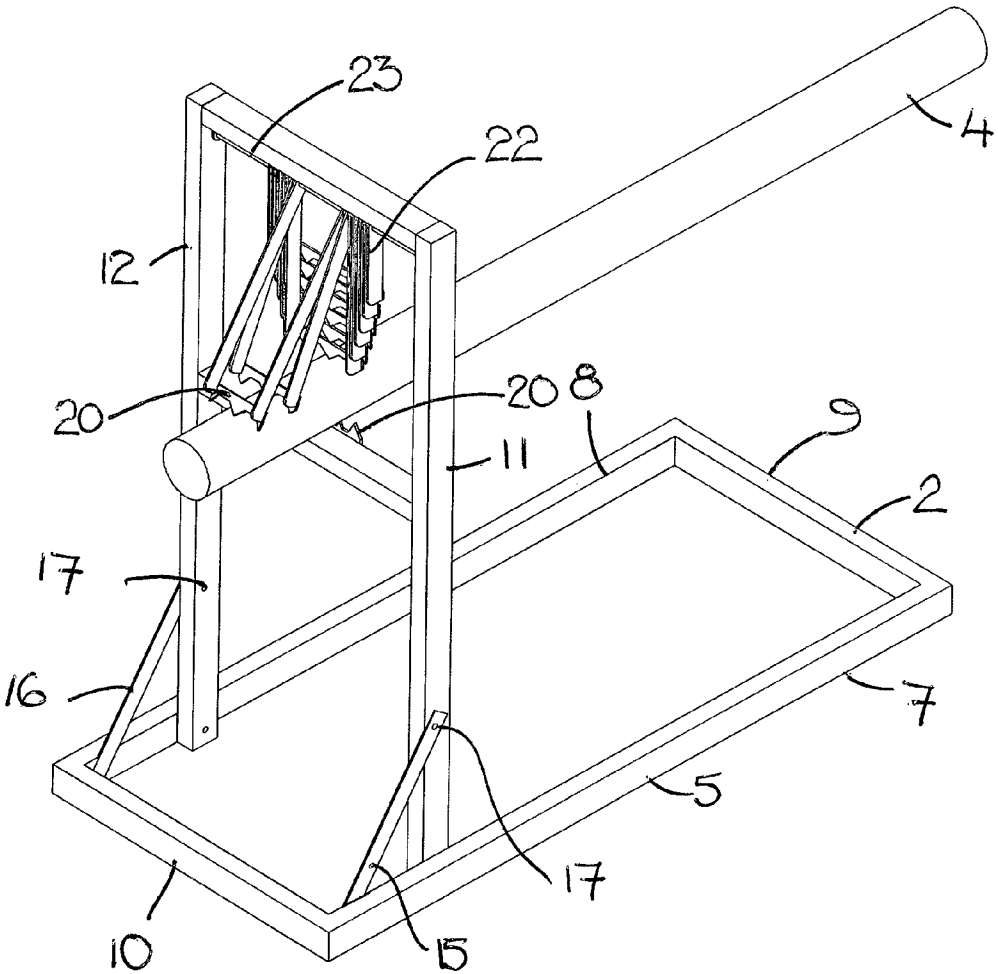
FIG. 2 is a rear perspective view from above and one side of the sawhorse of FIG. 1 showing jaw plates of the upper jaw of the jaw means gripping the log.
Figure 3:
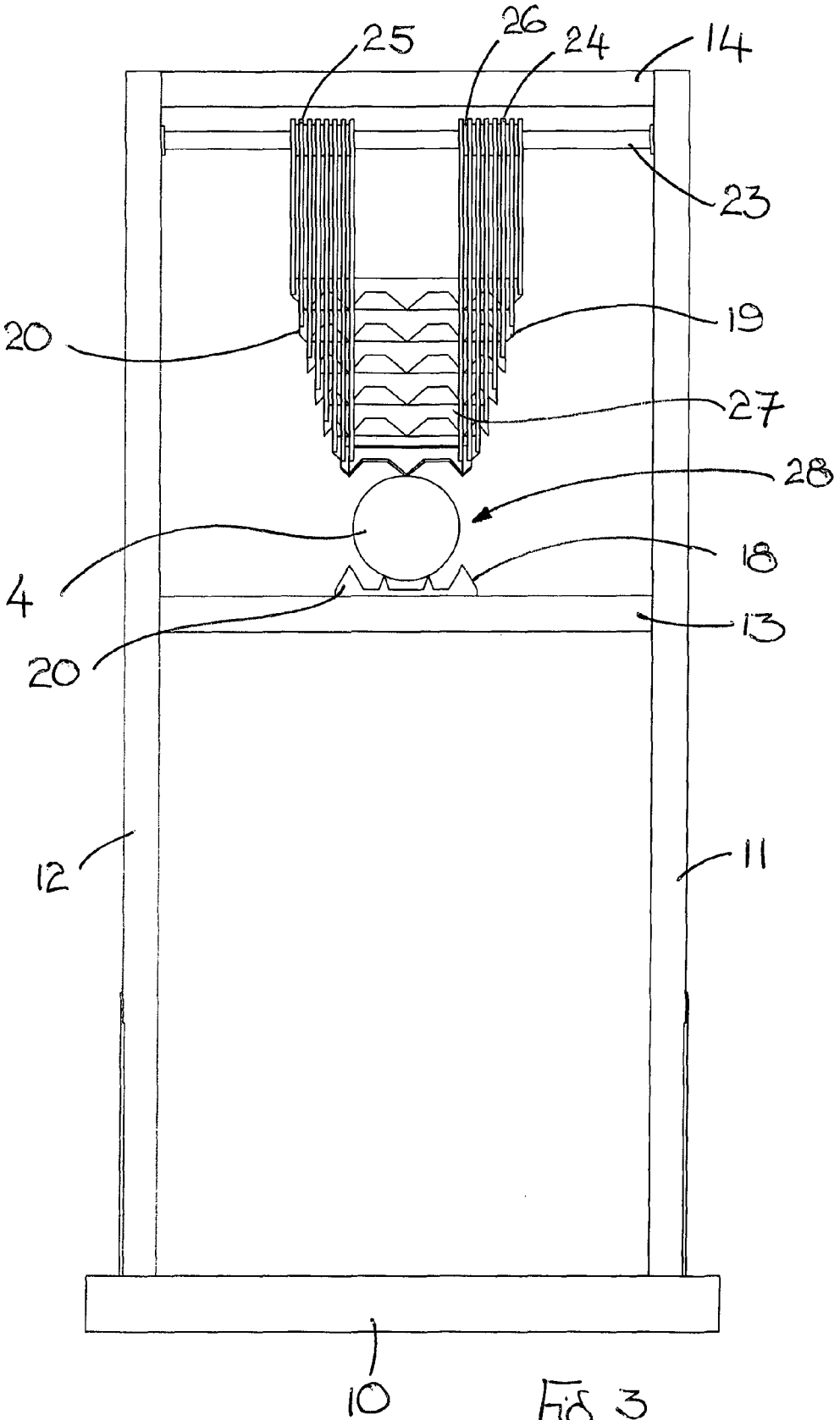
FIG. 3 is a rear elevation of the sawhorse of FIG. 2 showing the displaced jaw plates gripping the log.
Figure 4:
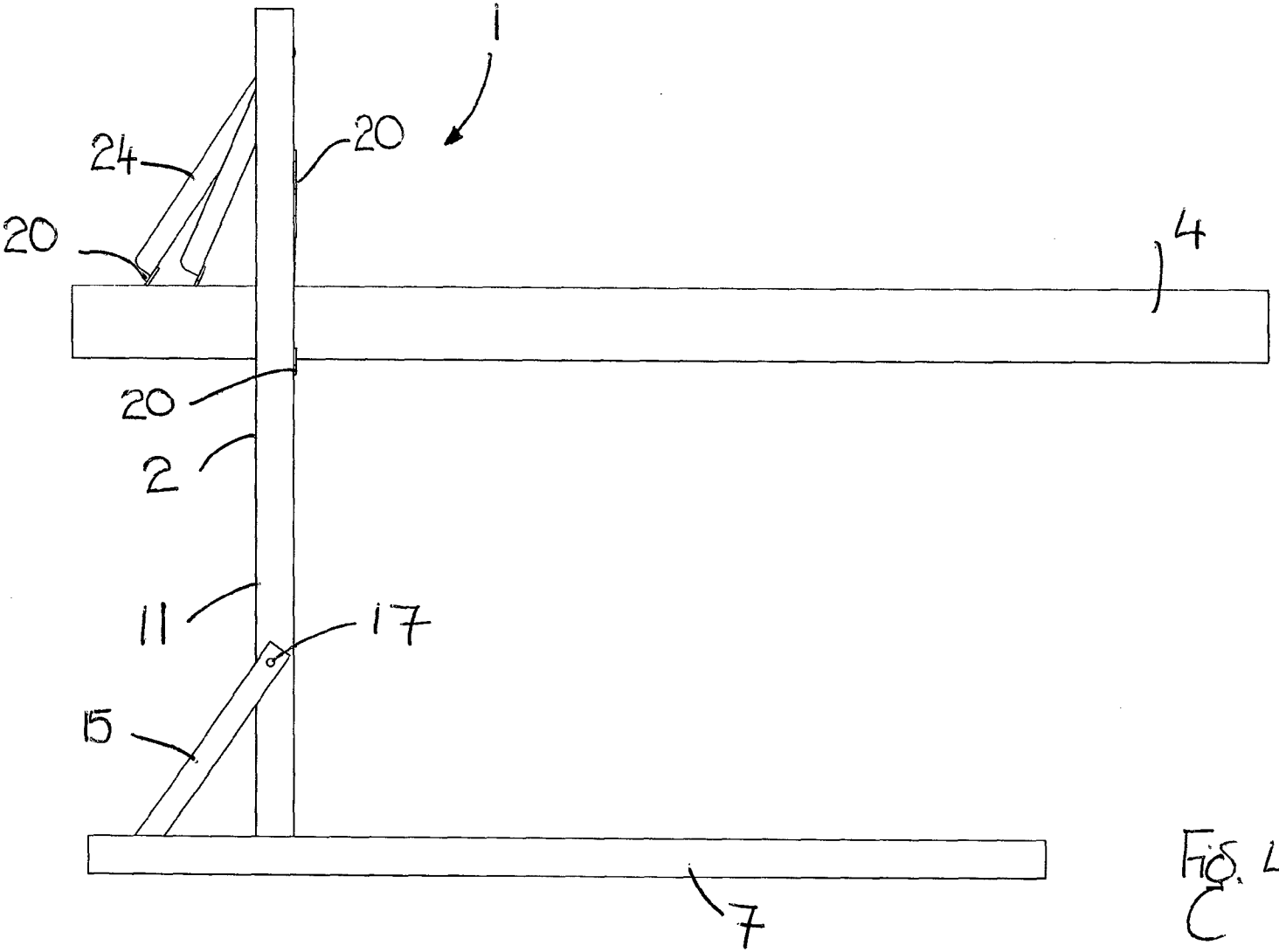
FIG. 4 is a side elevation of the sawhorse of FIG. 1.
Figure 5:
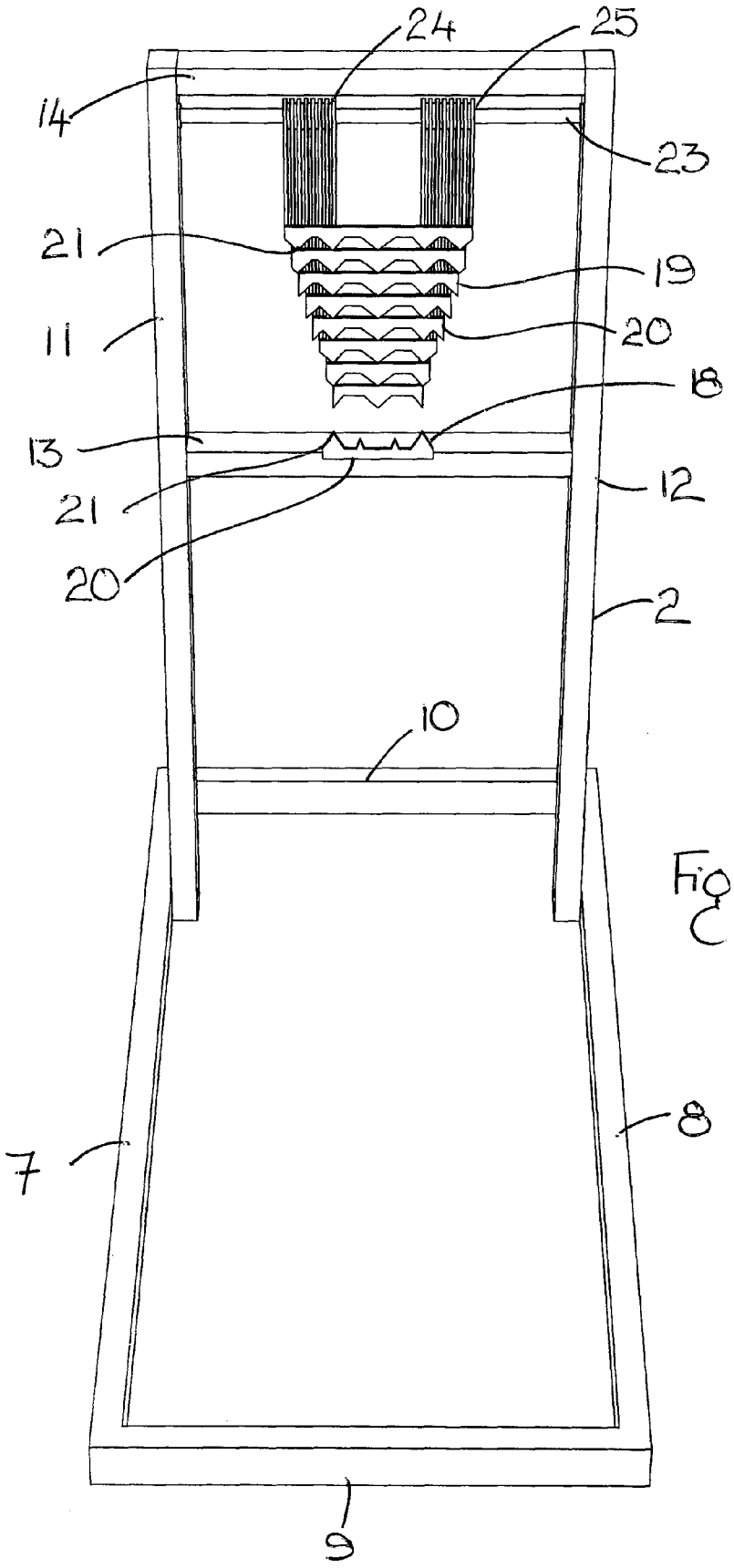
FIG. 5 is a front perspective view from above of the sawhorse not in use (with the log removed) showing the suspended series of cascading jaw plates of the upper jaw and the lower jaw of the jaw means of FIG. 1.
Figure 6:
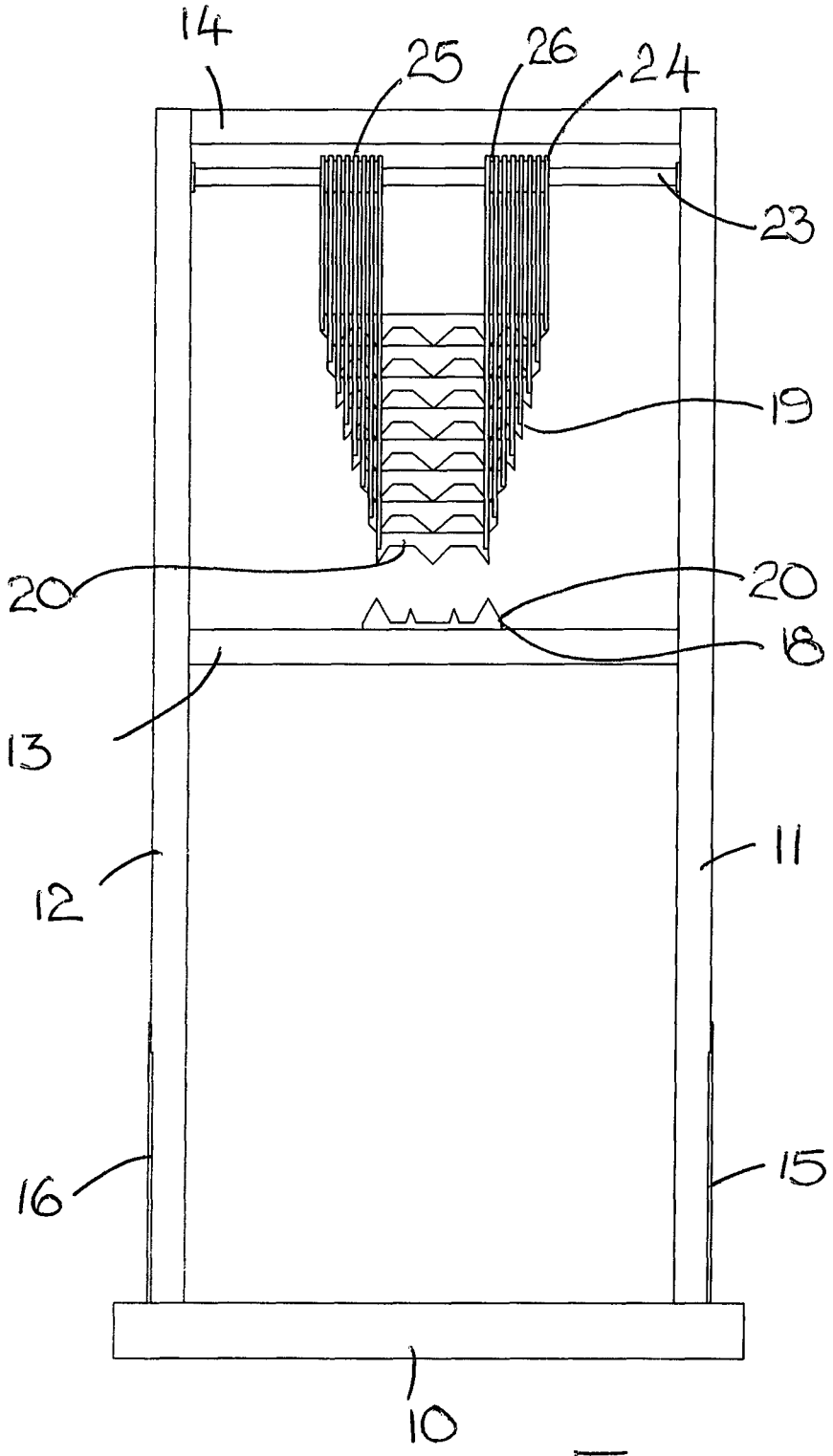
FIG. 6 is a rear elevation of the sawhorse of FIG. 5.
Figure 7:
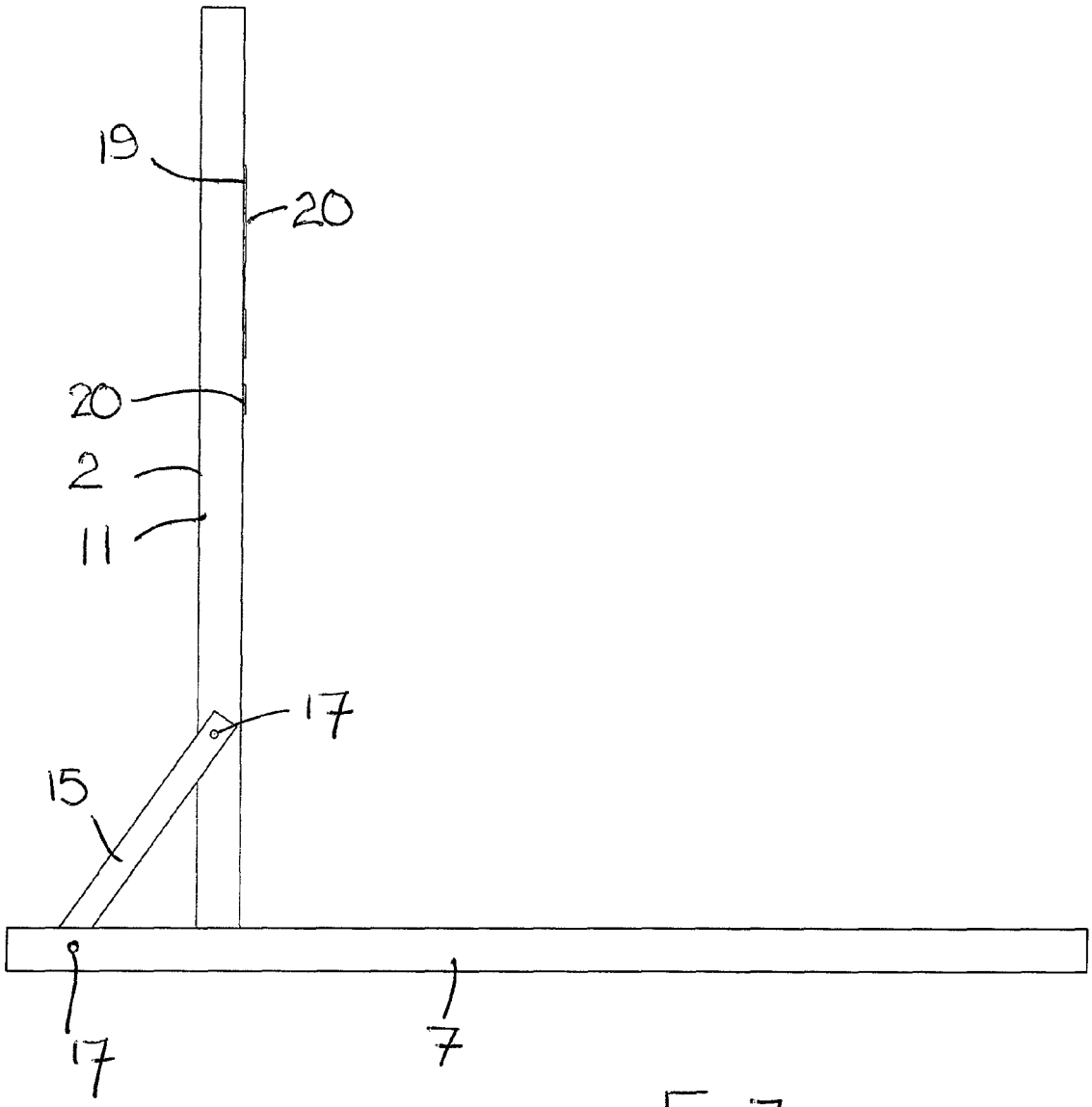
FIG. 7 is a side elevation of the sawhorse of FIG. 5.
Figure 8:
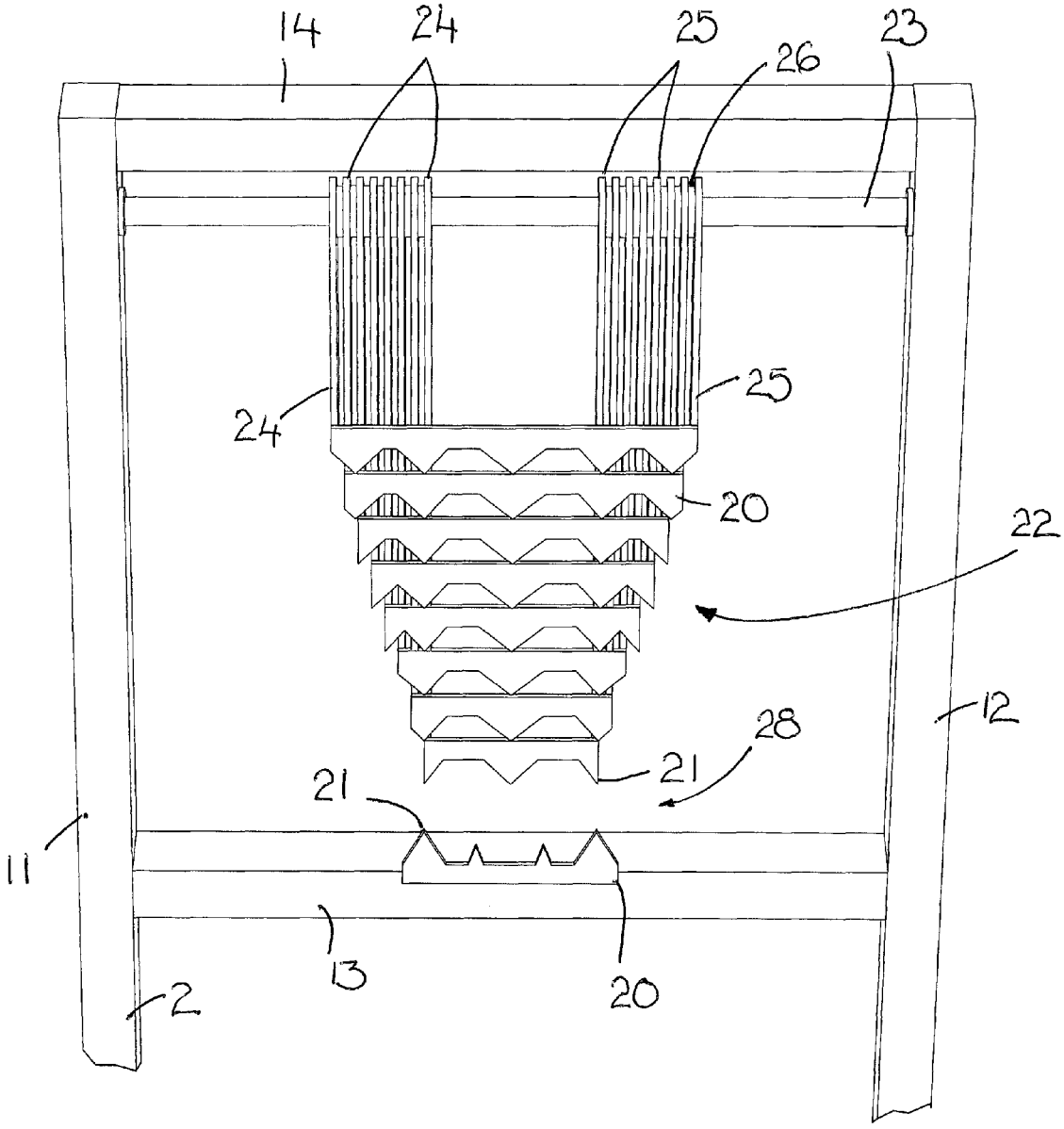
FIG. 8 is an enlarged perspective view from above and one side of the jaw means of the sawhorse of FIG. 5 showing the suspended series of cascading jaw plates of the upper jaw and the lower jaw with the largest jaw plate distal from the lower jaw.

FIGS. 1 to 8 show a first embodiment of a sawhorse 1 in accordance with the invention. As shown in the drawings, the sawhorse 1 is made up of a frame 2 provided with a self-adjusting jaw mechanism or means 3 for supporting a log 4 in a cantilevered fashion on the sawhorse 1. It should be noted that although reference is made to a log 4 in the following description, it is contemplated that the sawhorse 1 of the invention is of equal utility when used with planks or other processed or treated timbers.

The frame 2 of the sawhorse 1 is made up of a base support portion 5 and a frame upright portion 6 mounted on the base support portion 5. The base support portion 5 is substantially rectangular in shape and has a first side member 7, a second side member 8 parallel to the first side member 7, a front transverse member 9 extending between the first and second side members 7,8 and a rear transverse member 10 also extending between the first and second side members 7,8.

The frame upright portion 6 is also substantially rectangular in shape and is made up of a first upright member 11 attached to the first side member 7 and a second upright member 12 parallel to the first upright member 11 and attached to the second side member 8. The first and second upright members 11,12 are attached to the respective first and second side members 7,8 by nut and bolt fastenings 17.

The frame upright portion 6 is further provided with a lower jaw transverse support bar 13 which extends between the first and second upright members 11,12 and a top transverse member 14 which also extends between the first and second upright members 11,12.

The frame upright portion 6 is further supported on the base support portion 5 by first and second struts 15,16 which extend between the first and second side members 7,8 of the base support portion 5 and the first and second upright support members 11,12 respectively of the frame upright portion 6. The first and second struts 15,16 are secured at each end by nut and bolt fastenings 17.

The self-adjusting jaw means 3 is adapted to adapt to the dimensions of an item inserted in the jaw means 3 and is located on the frame upright portion 6. The jaw means 3 is made up of a fixed serrated lower jaw 18 on the lower jaw transverse support bar 13 and an opposed serrated self-adjusting and self-locking upper jaw 19 suspended from an upper jaw support bar 23 transversely mounted between the first upright member 11 and second upright member 12 below and adjacent to the top transverse member 14. As outlined further below, the suspended self-locking upper jaw 19 is pendulum-like so that the upper jaw 19 can move in a swinging motion between a first position in which the log 4 can be received or inserted in the sawhorse 1 and a second position in which the log 4 is gripped by the self-adjusting and self-locking jaw means 3.

The lower jaw 18 is formed from a jaw plate 20 centrally mounted on the lower jaw transverse support bar 13. The jaw plate 20 is fixed in-situ and is provided with upwardly disposed teeth 21 for gripping the log 4 on its underside.

The upper jaw 19 is made up of a series 22 of cascading jaw plates 20 in which each jaw plate 20 of the series 22 is located one above the other in a single vertical plane. In the present embodiment, the series 22 is made up of eight jaw plates 20 with the teeth of the jaw plates 20 being disposed downwards towards the teeth 21 of the jaw plate 20 of the lower jaw 18 to co-operate in gripping the log 4 in use between the lower jaw 18 and the upper jaw 19 as shall be explained more fully below.

Each jaw plate 20 of the series 22 is provided with a first support arm 24 and a second support arm 25 spaced apart from the first support arm 24 and secured to each plate 20 at its rear face 27. The support arms 24,25 extend between the jaw plate 20 and upper jaw support bar 23 and are pivotably mounted on the upper jaw support bar 23 to facilitate the pendent pendulum-like movement of the jaw plates 20 of the upper jaw 19.

In the present embodiment, the jaw plates 20 of the series 22 are dimensioned so that each plate 20 of the series 22 has a reduced lateral width compared with each preceding plate 20 in the series 22 to form a substantially V-shaped series 22. Accordingly, the plates 20 decrease in width as their distance from the upper jaw support bar 23 is increased i.e. the largest jaw plate 20 of the suspended series 22 of cascading jaw plates 20 is distal from the lower jaw 18 of the jaw means 3 and the smallest jaw plate 20 of the suspended series 22 of cascading jaw plates 20 is proximate to the lower jaw 18.

The first and second support arms 24,25 are spaced apart on the jaw plates 20 towards the outer edge of each jaw plate 20 so that first and second support arms 24,25 of each jaw plate 20 is spaced inwards from and adjacent to the first and second support arm 24,25 of the preceding jaw plate 20 in a nested arrangement to facilitate the suspension of the jaw plates 20 of the V-shaped series 22 in a single vertical plane.

The first and second support arms 24,25 are spaced apart on the upper jaw support bar 23 by bearings 26 mounted on the upper jaw support bar 23 between the first and second support arms 24,25.

The lowermost jaw plate 20 in the substantially V-shaped series 22 is spaced apart from the jaw plate 20 of the lower jaw 18 to define an opening 28 between the lower jaw 18 and the upper jaw 19 for receiving the log 4. The size of the opening 28 is self-adjusting in accordance with the size of the log 4 to be held and cut in accordance with movement of the jaw plates 20 of the upper jaw 19.

In use, the log 4 (or plank etc.) is inserted by a user into the opening 28 between the fixed lower jaw 18 and the moveable upper jaw 19. One or more of jaw plates 20 of the substantially V-shaped series 22 of jaw plates 20 of the upper jaw 19 are automatically pivoted rearwards on the upper jaw support bar 23 via their pivotable first and second support arms 24,25 in accordance with the thickness of the log so that the opening 28 is automatically adjusted to the size of the log 4 to hold the log 4 in position between lower jaw 18 and upper jaw 19. The log 4 can be locked in position by simply retracting the log 4 slightly to ensure that that the teeth 21 of the opposing jaw plates 20 of the lower jaw 18 and upper jaw 19 tightly grip the log 4. The log 4 is therefore securely cantilevered in position for cutting in a self-adjusting and self-locking manner by the sawhorse 1 of the invention.

Following cutting of the log 4, the remaining portion of the log 4 in the jaw means can simply be knocked through the opening 28 while inserting a subsequent log 4.

Figure 9:
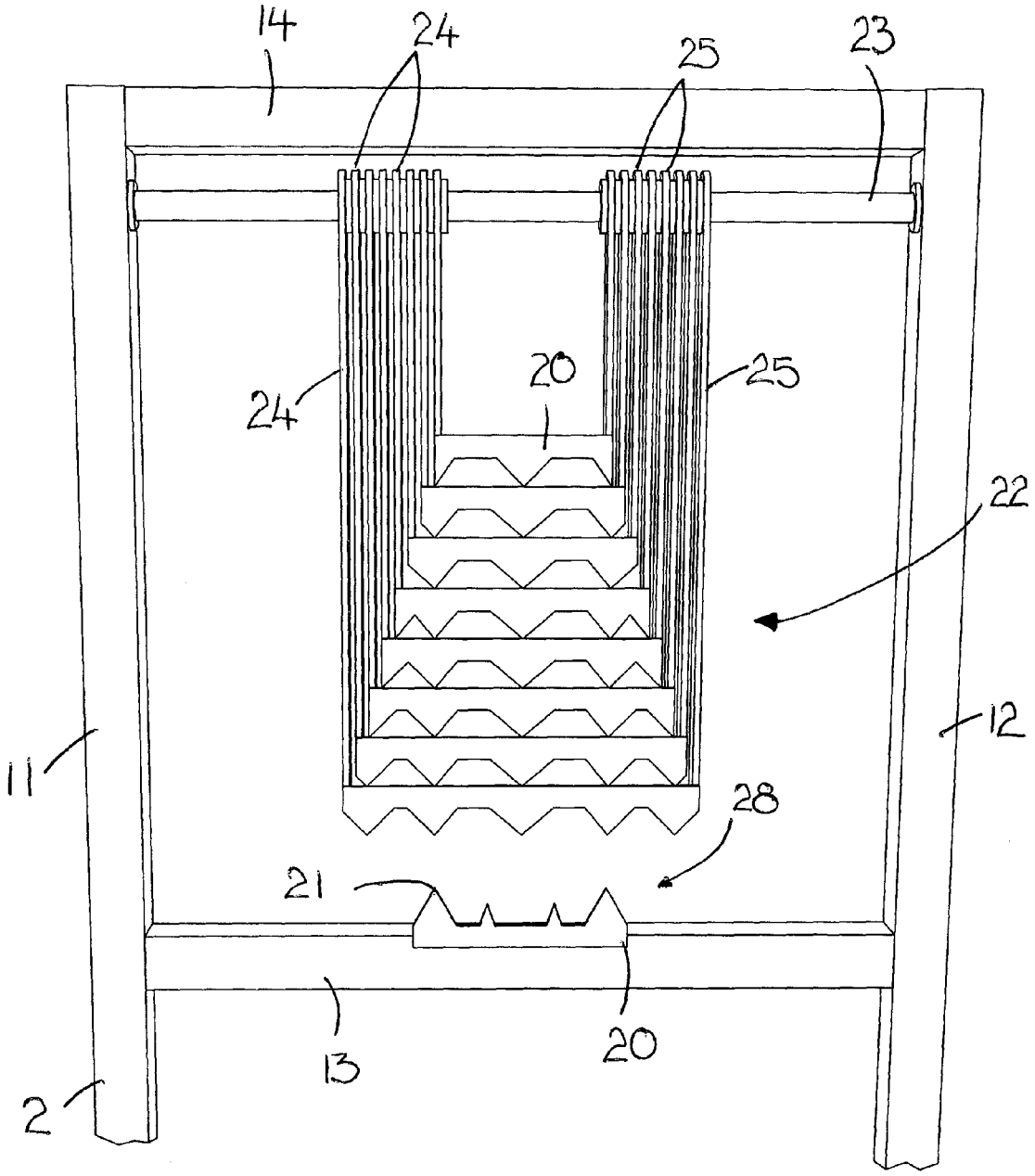
FIG. 9 is an enlarged perspective view from above and one side of the jaw means of a second embodiment of the invention in which the smallest jaw plate of the suspended series of cascading jaw plates is proximate to the lower jaw of the jaw means and the largest jaw plate of the suspended series of cascading jaw plates is proximate to the lower jaw.

FIG. 9 is an enlarged perspective view from above and one side of the jaw means 3 of a second embodiment of a sawhorse 1 of the invention broadly similar to the embodiment described in FIGS. 1 to 8. Like numeral indicate like parts.

However, in the present embodiment, the jaw plates 20 are suspended from the upper jaw support bar 23 to form a substantially A-shaped series 22 of cascading jaw plates 20 so that the smallest jaw plate 20 of the suspended series 22 of cascading jaw plates 20 is distal from the lower jaw 18 of the jaw means 3 and the largest jaw plate 20 of the suspended series 22 of cascading jaw plates 20 is proximate to the lower jaw 18. The sawhorse 1 of the present embodiment functions in an analogous fashion to the embodiment described in FIGS. 1 to 8 so that one or more of jaw plates 20 of the substantially A-shaped series 22 of jaw plates 20 of the upper jaw 19 are automatically pivoted rearwards on the upper jaw support bar 23 via their pivotable first and second support arms 24,25 in accordance with the thickness of a log so that the opening 28 is automatically adjusted to the size of a log to hold the log 4 in position between lower jaw 18 and upper jaw 19.

The sawhorse 1 of the invention can be formed from any suitable material such as box steel, angle steel and the like. The sawhorse can also be manufactured so that the frame 2 is hinged, e.g. at the nut and bolt fastenings 17, to render the sawhorse collapsible for ease of transport.

In a further embodiment of the invention, the sawhorse 1 can be fitted with a dedicated removable plank for forming the sawhorse 1 into a workbench and/or can also be provided with a chainsaw holder or similar as required. Accordingly, the sawhorse of the invention is adapted to function as a multi-functional workbench, worktable or similar.

The invention is not limited to the embodiments herein described which may be varied in construction and detail without departing from the scope of the invention.

The invention claimed is:

1. A sawhorse comprising:

a frame;

a self-adjusting jaw mechanism on the frame for receiving an item, the jaw mechanism comprising a pendent upper jaw made up of a series of cascading pivotable jaw plates suspended in a single vertical plane and pivotable between a first position for receiving an item in the sawhorse and a second position for holding the item in the sawhorse and a lower jaw spaced beneath the upper jaw;

the self-adjusting jaw mechanism being automatically responsive to the size of an item inserted in the jaw mechanism to hold the item in the sawhorse.

2. A sawhorse as claimed in claim 1 wherein the pivotable jaw plates are suspended from an upper jaw support bar on the frame.

3. A sawhorse as claimed in claim 1 wherein the series of jaw plates is substantially V-shaped.

4. A sawhorse as claimed in claim 1 wherein the series of jaw plates is substantially A-shaped.

5. A sawhorse as claimed in claim 1 wherein the lower jaw comprises a jaw plate fixed to the frame.

6. A sawhorse as claimed in claim 1 wherein the jaw plates are serrated.

7. A sawhorse as claimed in claim 1 wherein the serrated jaw plates comprise teeth for gripping an item.

8. A sawhorse as claimed in claim 1 wherein the frame is adapted to hold the item in the sawhorse in a cantilevered position.

9. A sawhorse as claimed in claim 3 wherein the frame is substantially L-shaped in profile.

* * * * *